United States Patent [19]

Nauheimer

[11] 4,428,499

[45] Jan. 31, 1984

[54] SIFT PROOF LINER FOR OUTER CONTAINER

[75] Inventor: James F. Nauheimer, Chicago, Ill.

[73] Assignee: Container Corporation of America, Chicago, Ill.

[21] Appl. No.: 376,678

[22] Filed: May 10, 1982

[51] Int. Cl.[3] ..... B65D 90/04

[52] U.S. Cl. ..... 220/470; 220/410; 229/39 R; 229/37 R; 229/41 B

[58] Field of Search ..... 220/470, 463, 408, 410; 229/39 R, 37 R, 41 B, 41 R, 57

[56] References Cited

U.S. PATENT DOCUMENTS

| | | | |
|---|---|---|---|
| 1,985,111 | 12/1934 | Shofer et al. | 220/470 |
| 2,055,086 | 9/1936 | Poppe | 220/410 X |
| 2,337,370 | 12/1943 | Broadfoot | 220/410 X |
| 2,563,619 | 8/1951 | Ringler | 229/37 R |
| 2,787,408 | 4/1957 | Andre | 229/41 B X |
| 3,021,042 | 2/1962 | Stumpf, Jr. | 229/37 R X |
| 3,074,617 | 1/1963 | Kindseth et al. | 229/41 B X |
| 3,412,924 | 11/1968 | Krzyzanowski | 229/37 R X |
| 3,565,325 | 2/1971 | Pugsley | 229/41 B X |
| 3,578,236 | 5/1971 | Arai | 229/57 X |
| 3,792,810 | 2/1974 | Tingley et al. | 229/39 R |
| 3,907,194 | 9/1975 | Davenport et al. | 229/39 R X |
| 4,169,539 | 10/1979 | Price | 220/410 |
| 4,192,446 | 3/1980 | Naito | 229/37 R |
| 4,267,957 | 5/1981 | Holmstrom | 229/37 R |
| 4,343,429 | 8/1982 | Cherry | 229/39 R X |

*Primary Examiner*—Allan N. Shoap
*Assistant Examiner*—Robert Petrik
*Attorney, Agent, or Firm*—Richard W. Carpenter; Davis Chin

[57] ABSTRACT

A collapsible sift-proof, leak-proof paperboard liner, for an outer shipping container having opposed pairs of side walls interconnected a pair of bellows members. Each of the bellow members includes a pair of first bellows elements and a pair of second bellow elements.

The pair of first bellows elements are foldably joined to a lower edge of a second side wall panel on a common fold line and are foldably joined to each other on a fold line extending normal to the common fold line.

The pair of second bellows elements are foldably joined to an adjacent edge of a bottom wall on a fold line overlying the common fold line and foldably joined to respective first bellows elements on diagonal fold lines.

1 Claim, 8 Drawing Figures

SIFT PROOF LINER FOR OUTER CONTAINER

BACKGROUND OF THE INVENTION

1. Field of the Invention

This invention relates to shipping containers and more particularly to a one-piece, sift-proof, paperboard liner for use in packaging powdered or semi-liquid material.

2. Description of the Prior Art

A prior art search in the United States Patent and Trademark Office directed to the subject matter of this application disclosed the following United States Letters Pat. Nos. 630,789; 785,102; 1,105,215; 1,168,539; 1,737,319; 1,998,543; 2,070,747; 2,142,342; 2,362,862; 2,412,547; 3,117,711; 3,182,883; 3,285,498; 4,091,984; 4,169,539.

None of the prior art patents uncovered in the search disclosed the specific bellows arrangement for the structure of the bottom portion of the liner as disclosed and claimed in the present invention.

SUMMARY OF THE INVENTION

It is an object of this invention to provide a one-piece, sift-proof, paperboard liner adapted to replace the presently used plastic bag within an outer shipping container for use in packaging powdered material or semi-liquid material.

A more specific object of the invention is the provision, in a package of the type described, of a paperboard liner having a unique bellows arrangement interconnecting the bottom and side walls of the container to make the container sift-proof and leakproof.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
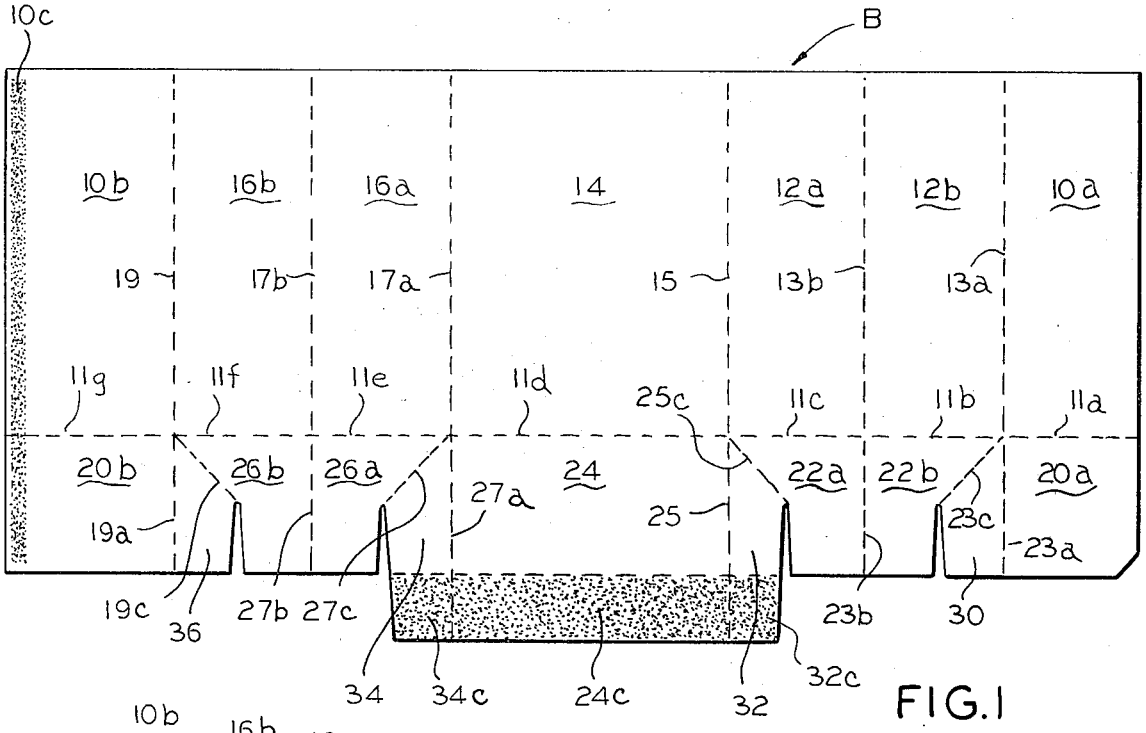
FIG. 1 is a plan view of a blank of foldable sheet material from which the liner illustrated in the other views may be formed.
Figure 2:
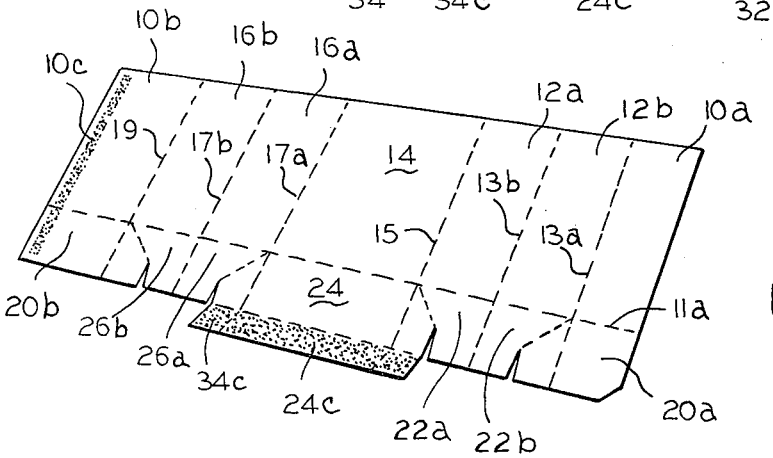
FIG. 2 is a perspective view of the structure illustrated in FIG. 1.
Figure 3:
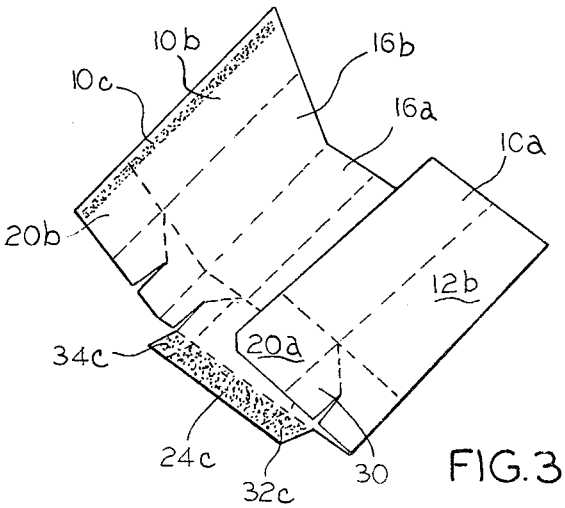
FIGS. 3, 4, 5, and 6 are perspective views showing the various stages in forming a liner from the structure illustrated in FIG. 2.

Referring now to the drawings for a better understanding of the invention, it will be seen that a one-piece paperboard liner, indicated generally at L, may be formed from a unitary blank B of foldable sheet material illustrated in FIG. 1.

Figure 8:
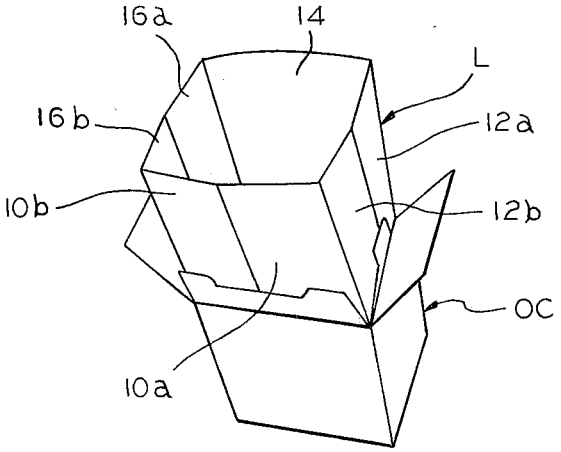
FIG. 8 is a perspective view showing a complete package, including an outer shipping container within which is being positioned a liner embodying features of the present invention.

As best seen in FIG. 8, the liner L is a adapted to be positioned within an outer shipping container OC in order to make the package sift-proof or leak-proof.

In the past plastic bags have been used as liners in packages of this type for holding powdered material and semi-liquid material, but it has been found that, where it is necessary to mix a material while it is still in the container, many times a plastic bag type liner gets ripped or torn during the mixing process. Thus, a paperboard liner is more rigid than a plastic bag and it has been found to be successful for this purpose.

Figure 7:
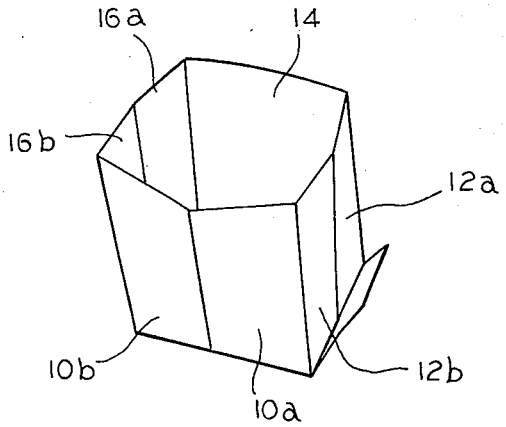
FIG. 7 is a perspective view of a liner embodying features of the present invention.

As best seen in FIGS. 1 and 7, liner L includes opposed pairs of first and second side walls connected to a bottom wall by means of a pair of bellows members.

Turning now to FIG. 1, it will be seen that blank B of foldable sheet material, which is used to form liner L, is cut and scored to provide a plurality of panels, incuding: first side wall inner partial panel 10*a*, second side wall second panel section 12*b*, second side wall first panel section 12*a*, first side wall complete panel 14, second side wall first panel section 16*a*, second side wall second panel section 16*b*, and first side wall outer partial panel 10*b*, which are foldably joined to each other along parallel fold lines 13*a*, 13*b*, 15, 17*a*, 17*b*, and 19, respectively.

Foldably joined to the lower edges of the previously described panels along fold lines 11*a*, 11*b*, 11*c*, 11*d*, 11*e*, 11*f*, and 11*g*, respectively, are bottom closure flap 20*a*, bellows member first element 22*b*, bellows member first element 22*a*, bottom closure flap 24, bellows member first element 26*a*, bellows member first element 26*b*, and bottom closure flap 20*b*.

Still referring to FIG. 1, it will be seen that bottom closure flap 24 is connected to adjacent first bellows elements 22*a* and 26*a* by a pair of second bellows elements 32 and 34 which are foldably joined to opposite side edges of bottom closure flap 24 on fold lines 25 and 27*a*, respectively, and which are foldably joined to adjacent first bellows elements 22*a* and 26*a* on diagonal fold lines 25*c* and 27*c*, respectively.

It will also be noted that bottom closure flaps 20*a* and 20*b* are foldably joined to adjacent first bellows elements 22*b* and 26*b* by second bellows elements 30 and 36, which are foldably joined on fold lines 23*a* and 19*a* to the bottom closure flaps and which are foldably joined to the adjacent first bellows elements 22*b* and 26*b* along diagonal fold lines 23*c* and 19*c*, respectively.

Still referring to FIG. 1, it will be seen that a glue flap comprising a central portion 24*c* and end portions 32*c* and 34*c* are foldably joined to the lower edges of bottom closure flap 24 and related second bellows elements 32 and 34, respectively.

Figure 4:
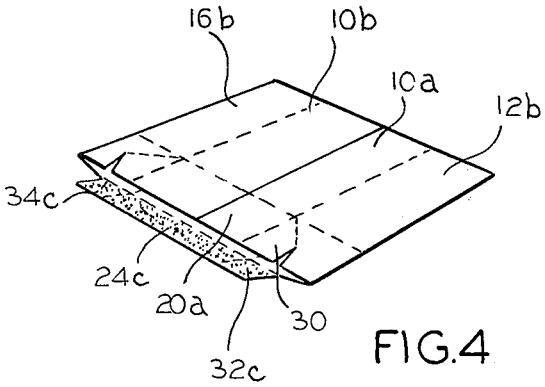

Turning now to FIGS. 3–6, it will be seen that to form the liner the ends of the blank are first folded over on top of the central portion of the blank along fold lines 13*b* and 17*b* which intersect or divide the second side wall panels into separate sections. As this is done, it will be seen that first side wall partial panels 10*a* and 10*b* overlie first side wall complete panel 14. First side wall outer partial panel 10*b* is provided with adhesive, as at 10*c*, and is secured thereby, along its marginal edge, to a marginal edge of overlying first side wall inner partial panel 10*a*. This structure at this point is illustrated in FIG. 4.

Figure 5:
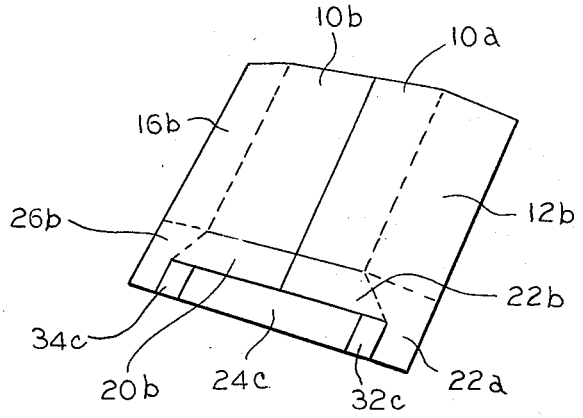
Figure 6:
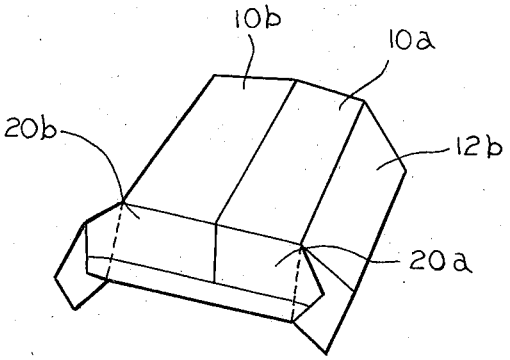

Now turning to FIGS. 5 and 6, it will be seen that to close the bottom of the liner, glue flap sections 24*c*, 32*c*, and 34*c* are folded 180°, so that glue flap section 24*c* overlies lower marginal portions of the bottom closure flaps 20*a* and 20*b*; whereas, glue flap sections 32*c* and 34*c* overlie lower marginal portions of second bellows elements 30 and 36.

After this has been done the liner is opened up, as shown in FIGS. 6 and 7, so that opposed side walls are substantially parallel to each other. At this point the bellows members at side of the liner are folded upwardly, as shown in FIGS. 7 and 8, so there is no opening between the side walls and the bottom wall of the container.

Thus the container is sift-proof and leak-proof and will permit the mixing of ingredients therein after the liner has been inserted into an outer container.

It will be understood that, liner intended to be filled with semi-liquid materials must, of course, be coated with a liquid-proof composition such as wax or plastic.

What is claimed is:

1. A one-piece blank of foldable sheet material, such as paperboard, which is cut and scored to form a collapsible, sift-proof, leak-proof liner for an outer shipping container, said blank comprising:

(a) a first side wall complete panel located generally centrally of said blank, a bottom closure flap joined to an end edge of said side wall complete panel;

(b) a pair of second side wall panel first sections foldably joined at their inboard side edges to opposite side edges of said first side wall complete panel;

(c) a pair of second side wall panel second sections foldably joined at their inboard side edges to adjacent outboard side edges of respective second side wall panel first sections;

(d) a pair of first side wall inner and outer partial panels foldably joined at their inboard side edges to adjacent outboard side edges of respective second side wall panel second section;

(e) bottom closure flaps foldably joined to corresponding end edges of each of said first side wall partial panels on the same side of said blank as said bottom closure flaps of said side wall complete panel;

(f) pairs of first bellows elements foldably joined to corresponding end edges of each of said second side wall panel first and second sections;

(g) the first bellows elements of each pair which are joined to adjacent second side wall panel sections also being foldably joined to each other;

(h) a first pair of second bellows elements foldably joined to opposite side edges of the bottom closure flap of said first said side wall complete panel and to the first bellows elements of said second side wall first sections along diagonal fold lines, said first pair of second bellows elements each being separated along the outboard side edge thereof; from said first bellows elements of said second side wall first sections by slots;

(i) a second pair of second bellows elements foldably joined to side edges of the bottom closure flaps of said first side wall partial panels and to the first bellows elements of said second side wall second sections along diagonal fold lines, said second pair of second bellows elements each being separated along the inboard side edge thereto from said first bellows elements of said second side wall second sections by slots;

(j) a glue flap foldably joined to a common edge of said first side wall complete panel bottom closure flap and both adjacent second bellows elements and extending outwardly from the remainder of the blank beyond all of the bottom closure flaps and bellows elements.

* * * * *